US006008580A

United States Patent [19]

Nakamura et al.

[11] Patent Number: 6,008,580

[45] Date of Patent: Dec. 28, 1999

[54] FLAT ILLUMINATION LIGHT HAVING A FLUORESCENT LAYER AND A SEALED PRESSURIZED VESSEL

[75] Inventors: Suehiro Nakamura; Hiroshi Mori, both of Kanagawa, Japan

[73] Assignee: Sony Corporation, Japan

[21] Appl. No.: 09/002,107

[22] Filed: Dec. 31, 1997

[30] Foreign Application Priority Data

Jan. 6, 1997 [JP] Japan ..... 9-000303
Nov. 28, 1997 [JP] Japan ..... 9-328763

[51] Int. Cl.[6] ..... H01J 17/20

[52] U.S. Cl. ..... 313/568; 313/584; 313/586; 313/587; 313/606; 313/620

[58] Field of Search ..... 313/584, 586, 313/587, 606, 620

[56] References Cited

U.S. PATENT DOCUMENTS 5,107,176 4/1992 Endo et al. ..... 313/581
5,343,115 8/1994 Anandan et al. ..... 313/581
5,477,105 12/1995 Curtin et al. ..... 313/422
5,723,945 3/1998 Schermerhorn ..... 313/581
5,770,921 6/1998 Aoki et al. ..... 313/581

*Primary Examiner*—Stephen Husar
*Assistant Examiner*—Ronald E. Delgizzi
*Attorney, Agent, or Firm*—Rader, Fishman & Grauer; Ronald P. Kananen

[57] ABSTRACT

A plurality of discharge electrodes (23), (24) are formed on a first substrate (22) at an interval between the adjacent electrodes set to 50 $\mu$m or smaller. A fluorescent layer (26) is formed on a second substrate (25 opposed to the first substrate (22). A sealed vessel (28) is formed by locating the first and second substrates (22) and (25) so that the electrodes (23) and (24) and the fluorescent layer (26) should be located on their inner sides. A predetermined gas is introduced in the sealed vessel (28) so that a pressure of the introduced gas should be within the range from 0.8 to 3.0 atmospheric pressure. Ultraviolet rays are produced by plasma discharge and make the fluorescent layer (26) emit light which is employed as illumination light.

46 Claims, 14 Drawing Sheets

FLAT ILLUMINATION LIGHT HAVING A FLUORESCENT LAYER AND A SEALED PRESSURIZED VESSEL

BACKGROUND OF THE INVENTION

1. Field of the Invention

The present invention relates to a flat illumination light which can be applied to, for example, an ordinary illumination light, a backlight for a liquid crystal display (LCD) or the like.

2. Description of the Related Art

Known illumination lights include a fluorescent lamp for domestic use, an electroluminescence (EL) for a backlight in a liquid crystal display or the like, and so on. A display apparatus utilizing a plasma discharge is also known.

FIGS. 1 and 2 are diagrams showing a plasma display apparatus by way of example. A plasma display apparatus 1 is formed of a transparent substrate, e.g., a glass substrate 4, having on its inner surface a plurality of stripe electrodes, i.e., anodes 2 and cathodes 3 made of transparent electrodes which are alternately arranged, and of a rear substrate 7 having on its inner surface a plurality of stripe address electrodes 5 and a fluorescent layer 6 extended in a direction perpendicular to the anodes 2 and cathodes 3.

Both substrates 4 and 7 are arranged opposite each other with a surface of the glass substrate 4, on the side of the anodes 2 and cathodes 3, and a surface of the rear substrate 7, on the side of the address electrodes 5 and the fluorescent layer 6, being disposed to face inward. Both of the substrates 4 and 7 form a sealed vessel 10 shielded in an airtight manner through a peripheral spacer 9.

In the sealed vessel 10, stripe barrier walls 11 perpendicular to the anodes 2 and cathodes 3 are provided so that each of the stripe barrier walls 11 is located between the adjacent address electrodes 5. The barrier walls 11 section the address electrodes 5 and the fluorescent layer 6.

In the plasma display apparatus 1, when a discharge maintaining voltage is applied between the anode 2 and the cathode 3 and then a discharge start voltage is applied between, for example, the cathode 3 and the address electrode 5, discharge between the corresponding anode 2 and the corresponding cathode 3 is produced. This discharge produces a plasma 13, and the fluorescent layer 6 is excited by ultraviolet rays 14 from the plasma 13 and emits light to carry out a desired display.

An interval between electrodes, i.e., an interval between the anode 2 and the cathode 3 in the above plasma display apparatus 1 is usually set within the range substantially from 100 $\mu$m to 200 $\mu$m.

In case of the illumination light, a fluorescent light has a cylindrical shape and hence has a considerable volume, making it difficult to reduce the size of the fluorescent light significantly. An electroluminescence (EL) tends not to deliver sufficient brightness or a desirable tone. Conventional plasma display apparatuses also tend to have brightness deficiencies.

SUMMARY OF THE INVENTION

In view of such aspects, it is an object of the present invention to provide a flat illumnation light which can provide satisfactory brightness and can be made thinner and a method of manufacturing the same.

According to a first aspect of the present invention, a flat illumination light has a plurality of discharge electrodes formed on the first substrate with an interval between the adjacent electrodes being set to 50 $\mu$m or smaller, a fluorescent layer formed on a second substrate opposite to the first substrate, and a sealed vessel formed by the first and second substrates so that the electrodes and the fluorescent layer are located on their inner sides. The gasses of one or more kinds of He, Ne, Ar, Xe and Kr are introduced into the sealed vessel so that a pressure of the introduced gasses should be set within the range from 0.8 to 3.0 atmospheric pressure.

According to a second aspect of the present invention, in the flat illumination light of the first aspect of the present invention, a dielectric layer or a dielectric layer and a protective film are formed on a surface of the discharge electrode.

According to a third aspect of the present invention, in the flat illumination light of the second aspect of the present invention, the protective film is formed of MgO.

According to a fourth aspect of the present invention, in the flat illumination light of the first aspect of the present invention, application of a voltage to the electrode is carried out by a DC drive or an AC drive.

According to a fifth aspect of the present invention, in the flat illumination light of the second or third aspect of the present invention, application of a voltage to the electrode is carried out by the AC drive.

According to a sixth aspect of the present invention, in the flat illumination light of the first aspect of the present invention, in the DC drive, the cathode is formed of oxidized metal, and the anode is formed of metal.

According to a seventh aspect of the present invention, in the flat illumination light of the first aspect of the present invention, in the AC drive, the cathode and the anode are both formed of oxidized metal or metal.

According to an eighth aspect of the present invention, in the flat illumination light of the fifth aspect of the present invention, the cathode and the anode are both formed of oxidized metal or metal.

According to a ninth aspect of the present invention in the flat illumination light of the first, second, third, fourth, fifth, sixth, seventh or eighth aspect of the present invention, Hg gas is mixed in the sealed airtight vessel.

According to a tenth aspect of the present invention in the flat illumination light of the first, second, third, fourth, fifth, sixth, seventh, eighth or ninth aspect of the present invention, if a pitch of the discharge electrodes is P, a distance between the discharge electrode and the fluorescent layer is L and a discharge angle is $\theta$, then the values are set so as to satisfy $P \leqq 2L \tan \theta$.

According to an eleventh aspect of the present invention, in the flat illumination light of the first, second, third, fourth, fifth, sixth, seventh, eighth, ninth or tenth aspect of the present invention, opposing surfaces of a pair of the discharge electrodes formed on the same plane are formed so as to be nonlinear.

According to a twelfth aspect of the present invention, a method of manufacturing a flat illumination light includes a step of forming a discharge electrode on a first substrate, a step of forming a fluorescent layer on a second substrate, a step of forming a sealed vessel by locating the first substrate and the second substrate so that the discharge electrode and the fluorescent layer are located on their inner sides, and a step of introducing a discharge gas into the sealed vessel so that a pressure in the sealed vessel should be within the range from 0.8 to 3.0 atmospheric pressure.

According to a thirteenth aspect of the present invention, a method of manufacturing a flat illumination light includes a step of forming a discharge electrode on a first substrate, a step of forming a dielectric layer or a dielectric layer and a protective film on the discharge electrode, a step of forming a fluorescent layer on a second substrate, a step of forming a sealed vessel by locating the first substrate and the second substrate so that the discharge electrode and the fluorescent layer are on their inner sides, and a step of introducing a discharge gas into the sealed vessel so that a pressure in the sealed vessel should be within the range from 0.8 to 3.0 atmospheric pressure.

According to a fourteenth aspect of the present invention, a flat illumination light includes a plurality of discharge electrodes formed on a first substrate with an interval between the adjacent electrodes being set to 50 $\mu$m or smaller, a reflective layer and a fluorescent layer formed on a second substrate opposite the first substrate, and a sealed vessel formed of the first and second substrates so that the electrodes and the fluorescent layer are located on their inner sides. Gasses of one or more kinds of He, Ne, Ar, Xe and Kr are introduced into the sealed vessel so that a pressure of the introduced gasses should be set within the range from 0.8 to 3.0 atmospheric pressure.

According to a fifteenth aspect of the present invention, in the flat illumination light of the fourteenth aspect of the present invention, the reflective layer is formed between the second substrate and the fluorescent layer.

According to a sixteenth aspect of the present invention, in the flat illumination light of the fourteenth or fifteenth aspect of the present invention, the reflective layer is formed of a high-reflectivity material.

According to a seventeenth aspect of the present invention, in the flat illumination light of the sixteenth aspect of the present invention, the high-reflectivity material is aluminum.

According to an eighteenth aspect of the present invention, in the flat illumination light of the fourteenth, fifteenth, sixteenth or seventeenth aspect of the present invention, a dielectric layer or a dielectric layer and a protective film are formed on a surface of the discharge electrode.

According to a nineteenth aspect of the present invention, in the flat illumination light of the eighteenth aspect of the present invention, the protective film is formed of MgO.

According to a twentieth aspect of the present invention, in the flat illumination light of the fourteenth, fifteenth, sixteenth or seventeenth aspect of the present invention, application of a voltage to the electrode is carried out by a DC drive or an AC drive.

According to a twenty-first aspect of the present invention, in the flat illumination light of the eighteenth or nineteenth aspect of the present invention, application of voltage to the electrode is carried out by the AC drive.

According to a twenty-second aspect of the present invention, in the flat illumination light of the fourteenth, fifteenth, sixteenth or seventeenth aspect of the present invention, in the DC drive, the cathode is formed of oxidized metal, and the anode is formed of metal.

According to a twenty-third aspect of the present invention, in the flat illumination light of the fourteenth, fifteenth, sixteenth or seventeenth aspect of the present invention, in the AC drive, the cathode and the anode are both formed of oxidized metal or metal.

According to a twenty-fourth aspect of the present invention, in the flat illumination light of the twenty-first aspect of the present invention, the cathode and the anode are both formed of oxidized metal or metal.

According to a twenty-fifth aspect of the present invention, in the flat illumination light of the fourteenth, fifteenth, sixteenth, seventeenth, eighteenth, nineteenth, twentieth, twenty-first, twenty-second, twenty-third or twenty-fourth aspect of the present invention, Hg gas is mixed in the sealed vessel.

According to a twenty-sixth aspect of the present invention, in the flat illumination light of the fourteenth, fifteenth, sixteenth, seventeenth, eighteenth, nineteenth, twentieth, twenty-first, twenty-second, twenty-third, twenty-fourth or twenty-fifth aspect of the present invention, if a pitch of the discharge electrodes is P, a distance between the discharge electrode and the fluorescent layer is L and a discharge angle is $\theta$, then the values are set so as to satisfy $P \leqq 2L \tan \theta$.

According to a twenty-seventh aspect of the present invention, in the flat illumination light of the fourteenth, fifteenth, sixteenth, seventeenth, eighteenth, nineteenth, twentieth, twenty-first, twenty-second, twenty-third, twenty-fourth, twenty-fifth or twenty-sixth aspect of the present invention, surfaces, opposed to each other, of a pair of the discharge electrodes formed on the same plane are formed so as to be nonlinear.

According to a twenty-eighth aspect of the present invention, a method of manufacturing a flat illumination light includes a step of forming a discharge electrode on a first substrate, a step of forming a reflective layer and a fluorescent layer on a second substrate, a step of forming a sealed vessel by locating the first substrate and the second substrate so that the discharge electrode and the fluorescent layer are on their inner sides, and a step of introducing a discharge gas into the sealed vessel so that a pressure in the sealed vessel should be within the range from 0.8 to 3.0 atmospheric pressure.

According to a twenty-ninth aspect of the present invention, a method of manufacturing a flat illumination light includes a step of forming a discharge electrode on a first substrate, a step of forming a dielectric layer or a dielectric layer and a protective film on the discharge electrode, a step of forming a reflective layer and a fluorescent layer on a second substrate, a step of forming a sealed vessel by locating the first substrate and the second substrate so that the discharge electrode and the fluorescent layer are on their inner sides, and a step of introducing a discharge gas into the sealed vessel so that a pressure in the sealed vessel should be within the range from 0.8 to 3.0 atmospheric pressure.

According to a thirtieth aspect of the present invention, a flat illumination light includes a reflective layer on a first substrate, a plurality of discharge electrodes formed on the first substrate with an interval between the adjacent electrodes being set to 50 $\mu$m or smaller, a fluorescent layer formed on a second substrate opposite the first substrate, and a sealed vessel formed of the first and second substrates so that the electrodes and the fluorescent layer are located on their inner sides. Gasses of one or more kinds of He, Ne, Ar, Xe and Kr are introduced into the sealed vessel so that a pressure of the introduced gasses should be set within the range from 0.8 to 3.0 atmospheric pressure.

According to a thirty-first aspect of the present invention, in the flat illumination light of the thirtieth aspect of the present invention, the reflective layer is formed between the first substrate and the fluorescent layer, and an insulating film is formed between the reflective layer and the discharge electrode.

According to a thirty-second aspect of the present invention, in the flat illumination light of the thirtieth or thirty-first aspect of the present invention, the reflective layer is formed of a high-reflectivity material.

According to a thirty-third aspect of the present invention, in the flat illumination light of the thirty-second aspect of the present invention, the high-reflectivity material is aluminum.

According to an thirty-fourth aspect of the present invention, in the flat illumination light of the thirtieth, thirty-first, thirty-second or thirty-third aspect of the present invention, a dielectric layer or a dielectric layer and a protective film are formed on a surface of the discharge electrode.

According to a thirty-fifth aspect of the present invention, in the flat illumination light of the thirty-fourth aspect of the present invention, the protective film is formed of MgO.

According to a thirty-sixth aspect of the present invention, in the flat illumination light of the thirtieth, thirty-first, thirty-second or thirty-third aspect of the present invention, application of a voltage to the electrode is carried out by a DC drive or an AC drive.

According to a thirty-seventh aspect of the present invention, in the flat illumination light of the thirty-fourth or thirty-fifth aspect of the present invention, application of a voltage to the electrode is carried out by the AC drive.

According to a thirty-eighth aspect of the present invention, in the flat illumination light of the thirtieth, thirty-first, thirty-second or thirty-third aspect of the present invention in the DC drive, the cathode is formed of oxidized metal, and the anode is formed of metal.

According to a thirty-ninth aspect of the present invention, in the flat illumination light of the thirtieth, thirty-first, thirty-second or thirty-third aspect of the present invention, in the AC drive, the cathode and the anode are both formed of oxidized metal or metal.

According to a fortieth aspect of the present invention, in the flat illumination light of the thirty-seventh aspect of the present invention, the cathode and the anode are both formed of oxidized metal or metal.

According to a forty-first aspect of the present invention, in the flat illumination light of the thirtieth, thirty-first, thirty-second, thirty-third, thirty-fourth, thirty-fifth, thirty-sixth, thirty-seventh, thirty-eighth, thirty-ninth or fortieth aspect of the present invention, Hg gas is mixed in the sealed vessel.

According to a forty-second aspect of the present invention, in the flat illumination light of the thirtieth, thirty-first, thirty-second, thirty-third, thirty-fourth, thirty-fifth, thirty-sixth, thirty-seventh, thirty-eighth, thirty-ninth, fortieth or forty-first aspect of the present invention, if a pitch of the discharge electrodes is P, a distance between the discharge electrode and the fluorescent layer is L and a discharge angle is θ, then the values are set so as to satisfy $P \leqq 2L \tan \theta$.

According to a forty-third aspect of the present invention, in the flat illumination light of the thirtieth, thirty-first, thirty-second, thirty-third, thirty-fourth, thirty-fifth, thirty-sixth, thirty-seventh, thirty-eighth, thirty-ninth, fortieth or forty-second aspect of the present invention, opposing surfaces of a pair of the discharge electrodes formed on the same plane are formed so as to be nonlinear.

According to a forty-fourth aspect of the present invention, a method of manufacturing a flat illumination light includes a step of forming a reflective layer on a first substrate, a step of forming a discharge electrode on the reflective layer through an insulating film, a step of forming a fluorescent layer on a second substrate, a step of forming a sealed vessel by locating the first substrate and the second substrate so that the discharge electrode and the fluorescent layer are located on their inner sides, and a step of introducing a discharge gas into the sealed vessel so that a pressure in the sealed vessel should be within the range from 0.8 to 3.0 atmospheric pressure.

According to a forty-fifth aspect of the present invention, a method of manufacturing a flat illumination light includes a step of forming a reflective layer on a first substrate, a step of forming a discharge electrode on the reflective layer through an insulating film, a step of forming a dielectric layer or a dielectric layer and a protective film on the discharge electrode, a step of forming a fluorescent layer on a second substrate, a step of forming a sealed vessel by locating the first substrate and the second substrate so that the discharge electrode and the fluorescent layer are located on their inner sides, and a step of introducing a discharge gas so that a pressure in the sealed vessel should be within the range from 0.8 to 3.0 atmospheric pressure.

DESCRIPTION OF THE PREFERRED EMBODIMENTS

Flat illumination lights according to embodiments of the present invention will hereinafter be described with reference to the accompanying drawings.

Figure 1:
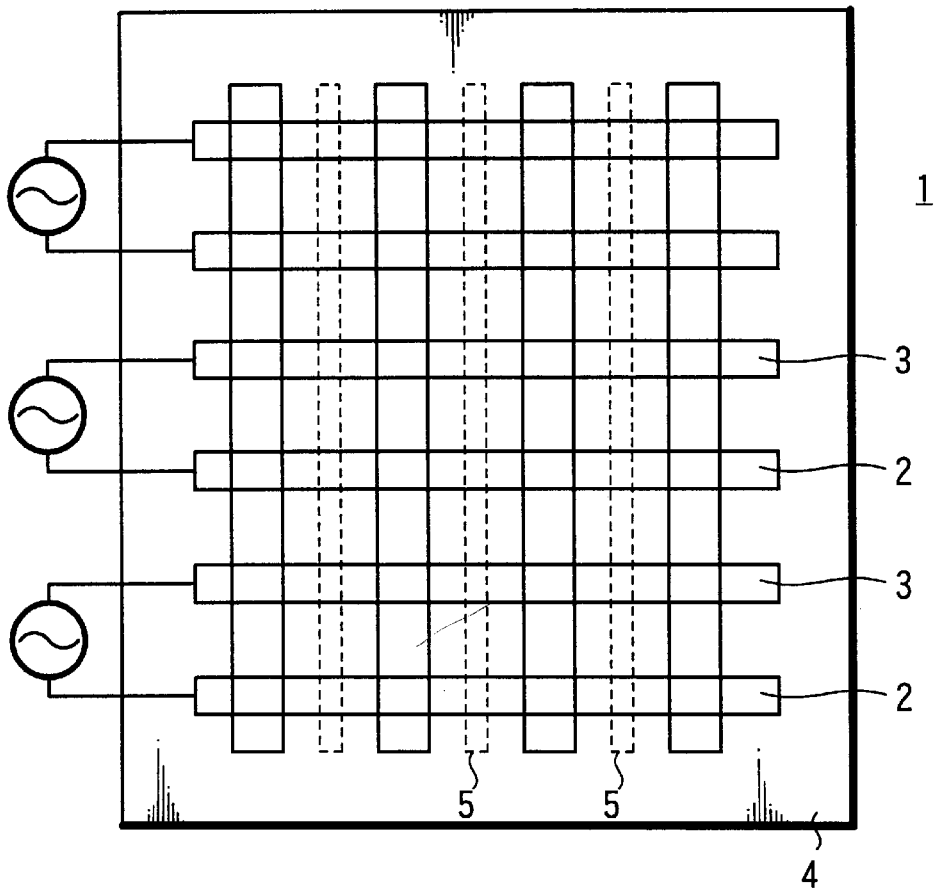
FIG. 1 is a plan view showing a plasma display device by way of example.
Figure 2:
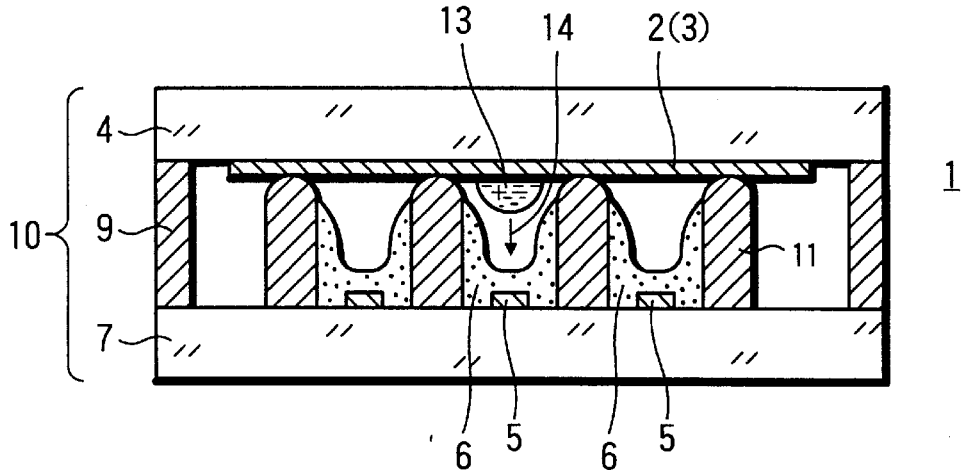
FIG. 2 is a cross-sectional view showing the plasma display device shown in FIG. 1.
Figure 3:
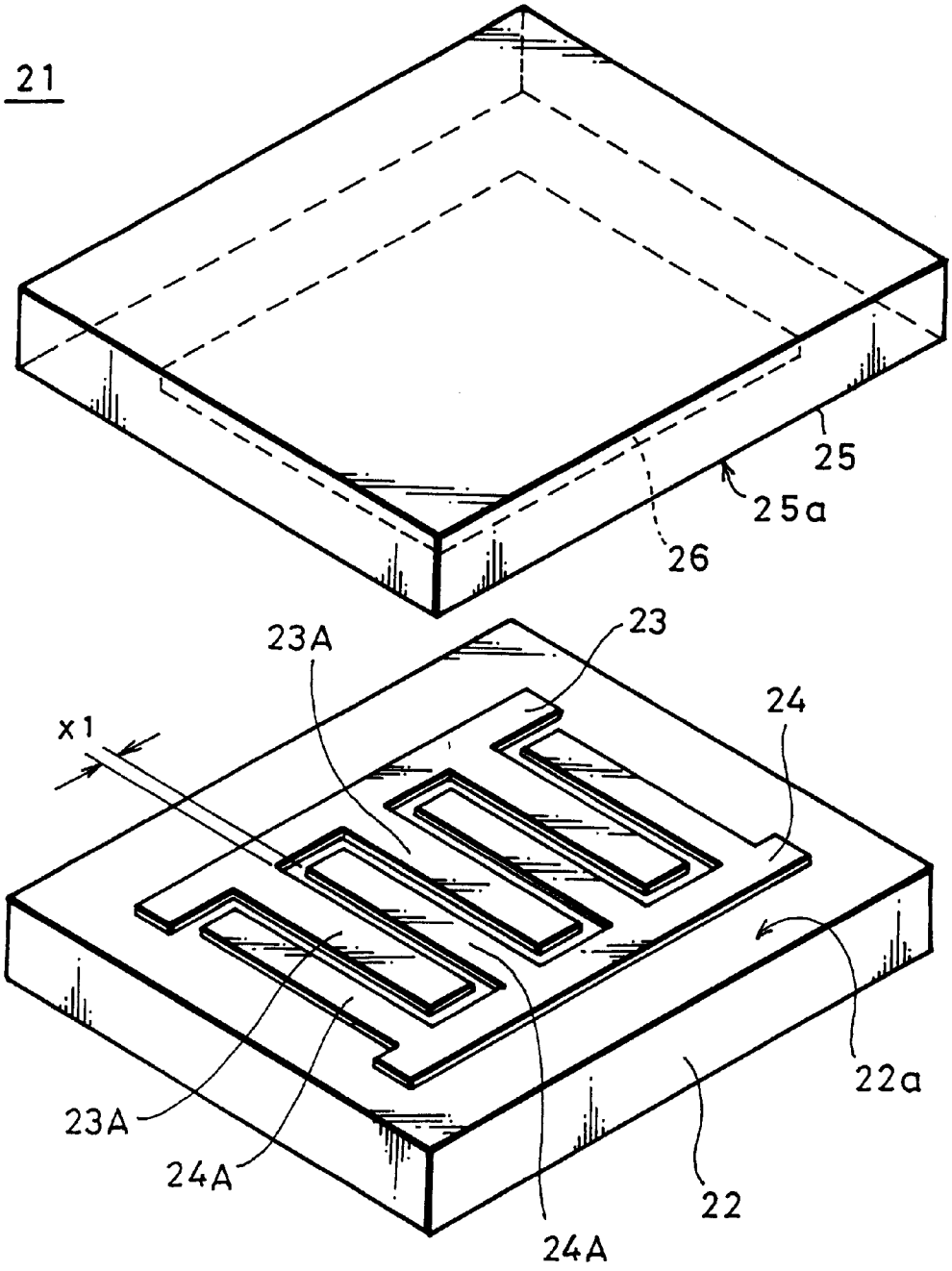
FIG. 3 is an exploded view showing a principle of an arrangement of a flat illumination light according to a first embodiment of the present invention.
Figure 4:
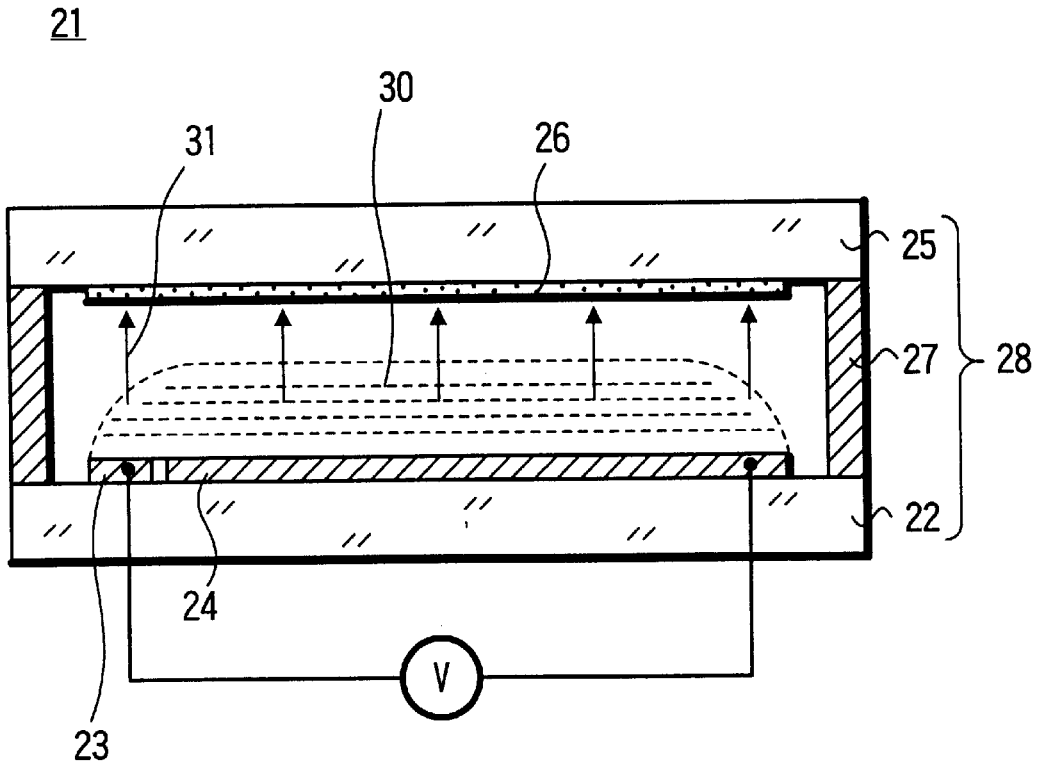
FIG. 4 is a cross-sectional view showing the principle of the arrangement of the flat illumination light according to the first embodiment of the present invention.

FIGS. 3 and 4 are diagrams each showing a principle of an arrangement of a flat illumination light according to a first embodiment of the present invention.

As shown in FIGS. 3 and 4, a flat illumination light 21 is arranged as follows. A pair of electrodes for discharge, i.e., an anode 23 and a cathode 24 are formed on one surface 22*a* of a first substrate, e.g., a glass substrate 22. A fluorescent layer 26 is coated on one surface 25*a* of a second substrate, e.g., a glass substrate 25 opposed to the first glass substrate 22. Further, the first and second glass substrates 22 and 25 are disposed so as to be opposite each other with the electrodes, i.e., the anode 23 and the cathode 24 and the fluorescent layer 26 being respectively located inside, and then sealed through a spacer 27.

A sealed vessel 28 is formed of the first glass substrate 22, the second glass substrate 25 and the spacer 27.

The one anode 23 has a plurality of electrode portions 23A arranged in parallel to one another and connected together at one end so that the anode 23 is comb-shaped. The other cathode 24 has a plurality of electrode portions 24A arranged in parallel to one another and connected together at one end so that the cathode 24 is comb-shaped.

The anode 23 and the cathode 24 are formed on the glass substrate 22 at a predetermined interval $x_1$ between electrodes so that each of the electrode portions 23A of the anode 23 and each of the electrode portions 24A of the cathode 24 are interleaved with each the other. Specifically, a plurality of the anode electrode portions 23A and a plurality of cathode electrode portions 24A are alternately arranged.

The interval $X_1$ between the electrode portions is set to 50 $\mu$m or smaller, e.g., within the range from 5 $\mu$m to 20 $\mu$m. Further, it is possible to set the interval $X_1$ between the electrode portions to 5 $\mu$m or smaller or to 1 $\mu$m or smaller, e.g., 0.5 $\mu$m.

One or more gasses selected from He, Ne, Ar, Xe, Kr and so on, for example, are sealed in the sealed vessel 28 so that a pressure of a sealed gas should be set within the range from 0.8 to 3.0 atmospheric pressure, e.g., 0.9 to 2.0 atmospheric pressure. Further, Hg gas may be mixed with the selected gasses.

For example, the flat illumination light 21 can be arranged such that the interval $x_1$ between electrode portions is set to 10 $\mu$m and XeNe mixture gas is sealed therein so that the pressure of the sealed gas is set to 1.0 atmospheric pressure.

In this flat illumination light 21, a desired voltage V is applied between the anode 23 and the cathode 24 to produce a surface discharge between the anode 23 and the cathode 24. This discharge generates a plasma 30. As a result, ultraviolet rays 31 resulting from this plasma 30 excites the fluorescent layer 26, and the fluorescent layer 26 emits illumination light. At this time, if the interval $x_1$ between the electrode portions is set to 50 $\mu$m or smaller, e.g., within the range from 5 $\mu$m to 20 $\mu$m and further set to 5 $\mu$m or smaller or 1 $\mu$m or smaller and the pressure of the sealed gas is set large, e.g., within the range from 0.8 to 3.0 atmospheric pressure, a large amount of ultraviolet rays 31 are consequently generated, which allows the fluorescent layer 26 to emit bright light.

Since the anode 23 and the cathode 24 are formed on the same surface 22*a* of the first glass substrate 22 and the fluorescent layer 26 is formed on the surface 25*a* of the second glass substrate 25, the plasma 30 generated by the discharge is prevented from being brought in contact with the fluorescent layer 26, and hence charged particles in the plasma 30 are prevented from impinging on the fluorescent layer 26, which can avoid deterioration of the fluorescent layer 26.

If one kind of the fluorescent layer 26 is selected, then illumination light having an optional color temperature can be obtained.

According to this embodiment, since the first and second glass substrates 22, 25 are sealed through the spacer 27 to form the flat sealed vessel 28, it is possible to form an extremely thin flat illumination light.

Figures 5A, 5B:
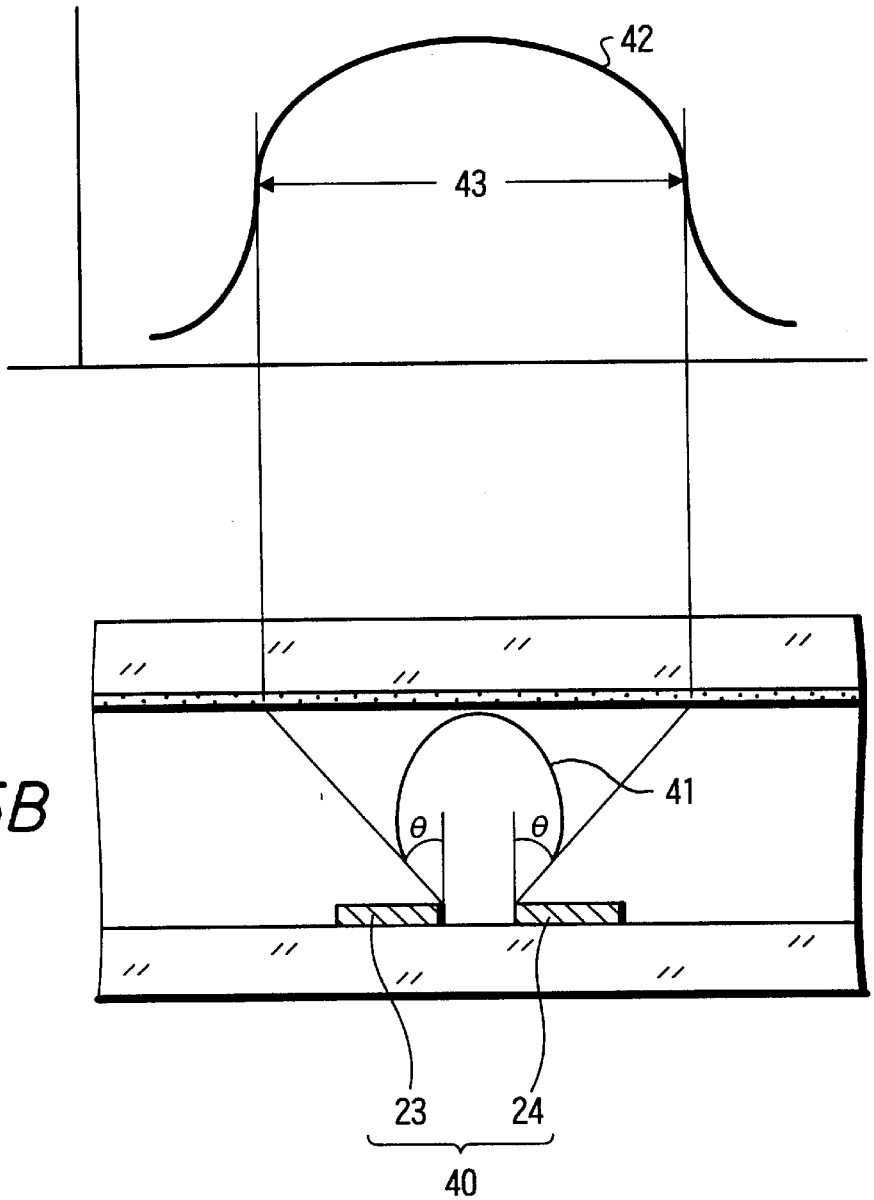
FIG. 5A is a graph showing a distribution of a light amount used to explain the flat illumination light according to the first embodiment of the present invention.
FIG. 5B is a cross-sectional view showing a main part of the flat illumination light according to the first embodiment of the present invention.

As shown in FIG. 5B, the fluorescent layer 26 emits light having a distribution 42 as shown in FIG. 5A corresponding to an ultraviolet ray irradiation region 41 produced by discharge from a discharge electrode pair 40 formed of the anode 23 and the cathode 24. A region where light is recognized as being bright is defined as an effective light emission region 43, and an angle θ of a discharge portion between the electrodes 23, 24 relative to each end of the effective light emission region 43 is defined as a discharge angle.

Figure 6:
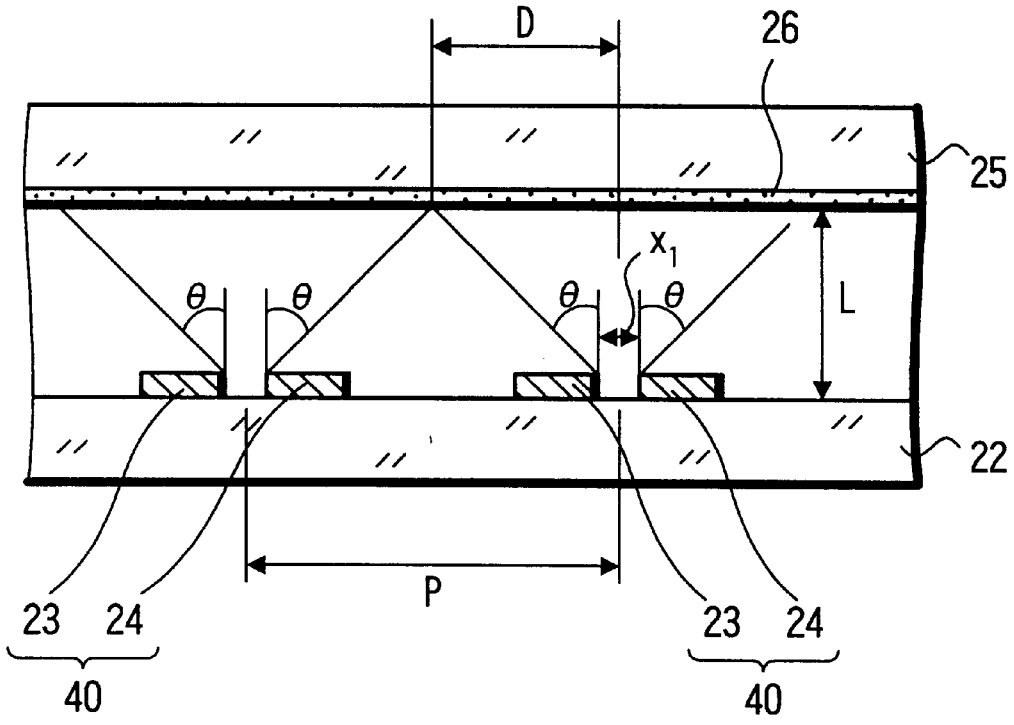
FIG. 6 is a cross-sectional view used to explain the flat illumination light according to the first embodiment of present invention

As shown in FIG. 6, it is assumed that a pitch between the discharge electrode pairs 40 formed by the anode 23 and the cathode 24 is P, a distance in a discharge space between the discharge electrode (the anode 23 and the cathode 24) and the fluorescent layer 26 is L, and a distance of a light emission region, within the range of the discharge angle θ of the fluorescent layer 26 is D. At this time, if the pitch P between the adjacent discharge electrode pairs 40 satisfies a condition expressed in the following equation 1, bright light is emitted from an entire surface of the fluorescent layer 26 in view of a design thereof.

Practically, since the interval between electrodes $x_1$ is set to about 10 $\mu$m and the distance L between the discharge electrode and the fluorescent layer can be set to 100 $\mu$m or larger, $x_1 \ll L$ is established.

$$D = L \tan\theta$$

$$P = 2D = 2L \tan\theta \qquad \text{(equation 1)}$$

Accordingly, in this embodiment, the flat illumination light is formed by setting the pitch P of the discharge electrode pair 40 so that the condition of $$P \leqq 2L \tan\theta$$

should be satisfied. This provides satisfactory light emission that is uniform over the entire surface.

If the discharge angle θ is set to 70°, for example, then $P \leqq L \times 3.9$ is established. Further, if the pitch P of the discharge electrode pair is set equal to or smaller than a value which is 3.9 times as large as the distance L (i.e., the distance between the glass substrates 22 and 25), then a discharge light emission with no discontinuity can be obtained.

If the luminance of the flat illumination light of this kind is increased, then it is possible to increase the light emission amount by increasing a length of the discharge electrode to thereby enlarge a discharge area.

For this end, in this embodiment, it is possible to S employ an arrangement which can substantially increase the length of the discharge electrode by forming the pair of discharge electrodes, i.e., the anode 23 and the cathode 24 so that the electrode portions 23A and 24A thereof are nonlinear instead of being linear.

Figure 7A:
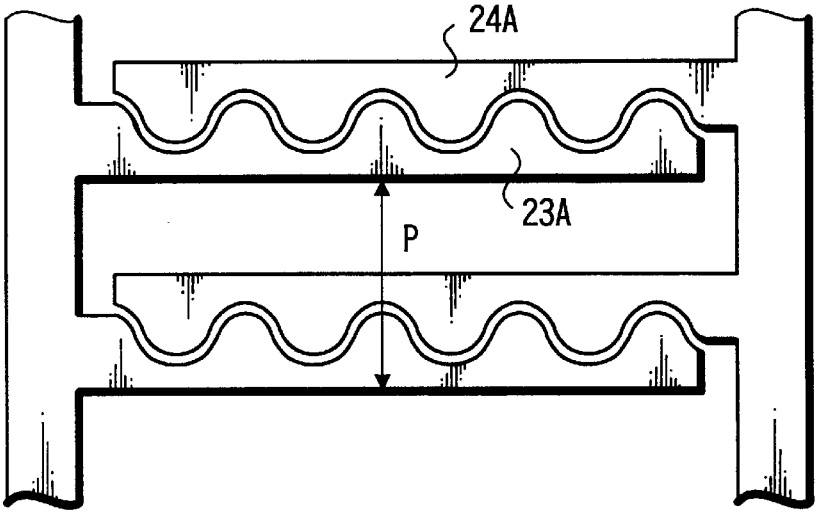
FIGS. 7A to 7C are diagrams showing a shape of a discharge electrode according to the first embodiment.
Figure 7B:
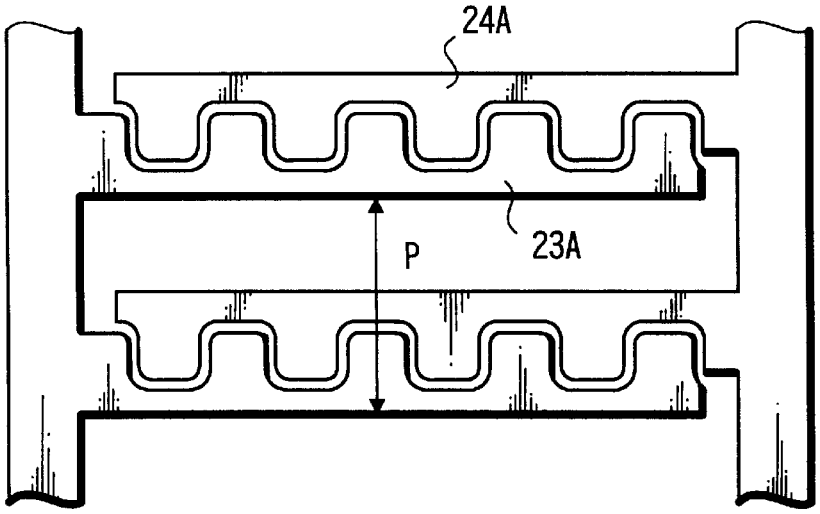
Figure 7C:
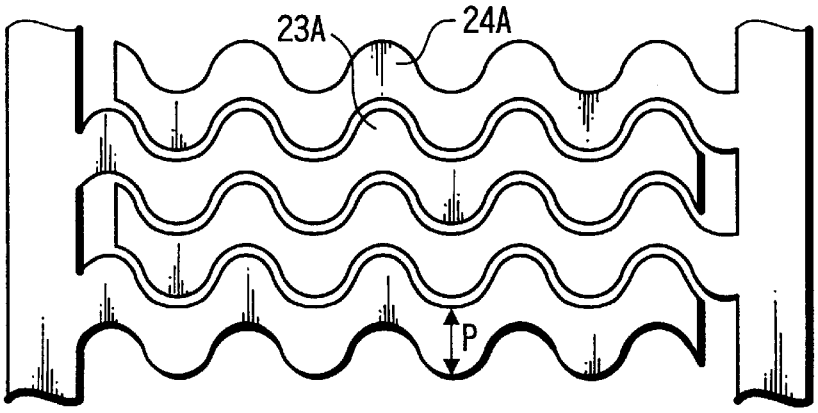

FIGS. 7A to 7C are diagrams showing examples of such an arrangement.

As shown in FIG. 7A, the pair of the discharge electrodes, i.e., the anode electrode portion 23A and the cathode electrode portion 24A, are formed so that their respective opposing surfaces are corrugated or wave-shaped.

As shown in FIG. 7B, the pair of the discharge electrodes, i.e., the anode electrode portion 23A and the cathode electrode portion 24A, are formed so that their respective opposing surfaces are curved so as to be substantially rectangular-wave-shaped.

As shown in FIG. 7C, the anode electrode portions 23A and the cathode electrode portions 24A are alternately formed on the same plane to produce the discharge between the anode electrode portion 23A and the cathode electrode portion 24A adjacent to each other, and their opposing surfaces are formed so as to be curved.

It is possible to easily form curved discharge electrode portions 23A and 24A by printing or photolithography.

When the electrode portions 23A, 24A on the same plane are formed so that their opposing surfaces are curved, it is possible to substantially increase the lengths of the electrode portions 23A, 24A, and hence it is possible to improve the luminance of the flat illumination light.

If the electrode pattern shown in FIG. 7C is employed, the pitch P between the discharge electrode pairs is fine, which can provide the high-luminance illumination. If the electrode patterns shown in FIGS. 7A and 7B are employed, the pitch P between the discharge electrode pairs is rough, which can provide soft illumination.

In this embodiment, a DC voltage or an AC voltage can be employed as a drive voltage applied to the anode 23 and the cathode 24.

Figure 8:
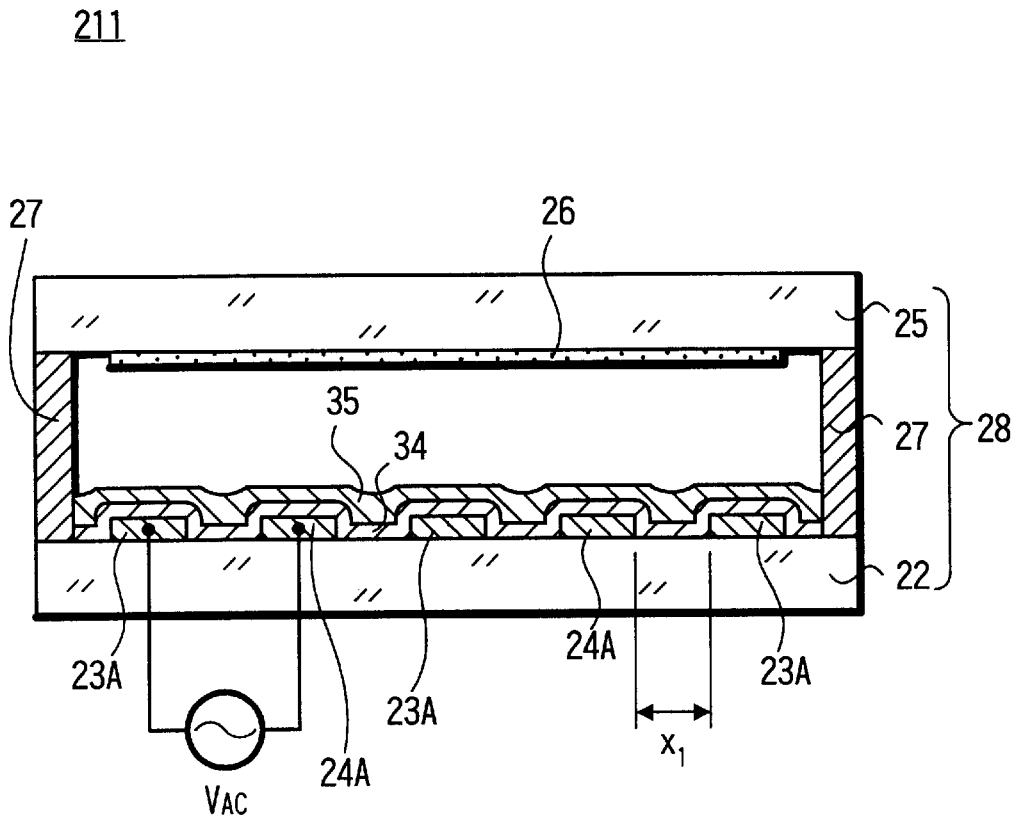
FIG. 8 is a cross-sectional view showing an example of a flat illumination light of an AC drive system according to the first embodiment of the present invention.

FIG. 8 is a diagram showing a flat illumination light 211 of an AC drive system by way of example. In this flat illumination light 211, a dielectric layer 34 made of glass, for example, having a thickness ranging from 0.1 to 4.0 $\mu$m is formed on both of the electrodes 23 and 24 or electrode portions 23A and 24A located at an interval $X_1$ therebetween set to 10 $\mu$m, for example. It is preferable to also form on the dielectric layer 34 an MgO layer 35 having a thickness of 0.5 $\mu$m, for example, and serving as a protective film and serving to lower a discharge start voltage. An AC voltage is applied between both of the electrodes 23, 24. Since this flat illumination light 211 is driven by the AC, positive voltage and negative voltage are alternately applied to each of the electrodes 23 and 24, and hence each of the electrodes 23 and 24 serves as an anode and a cathode alternately.

A discharge operation usually oxidizes a cathode-side electrode and deoxidizes an anode-side electrode. However, both of the electrodes 23 and 24 employed in the AC drive system may be transparent electrodes formed of oxidized metal film such as an ITO ($InO_3$+$SnO_2$) film, an $SnO_2$ film, an $I_2O_3$ film or the like, or may be formed of metal such as Al, Cu, Ni, Fe, Cr, Zn, Au, Ag, Pb or the like or of alloy formed of some of the above metals.

Figure 9:
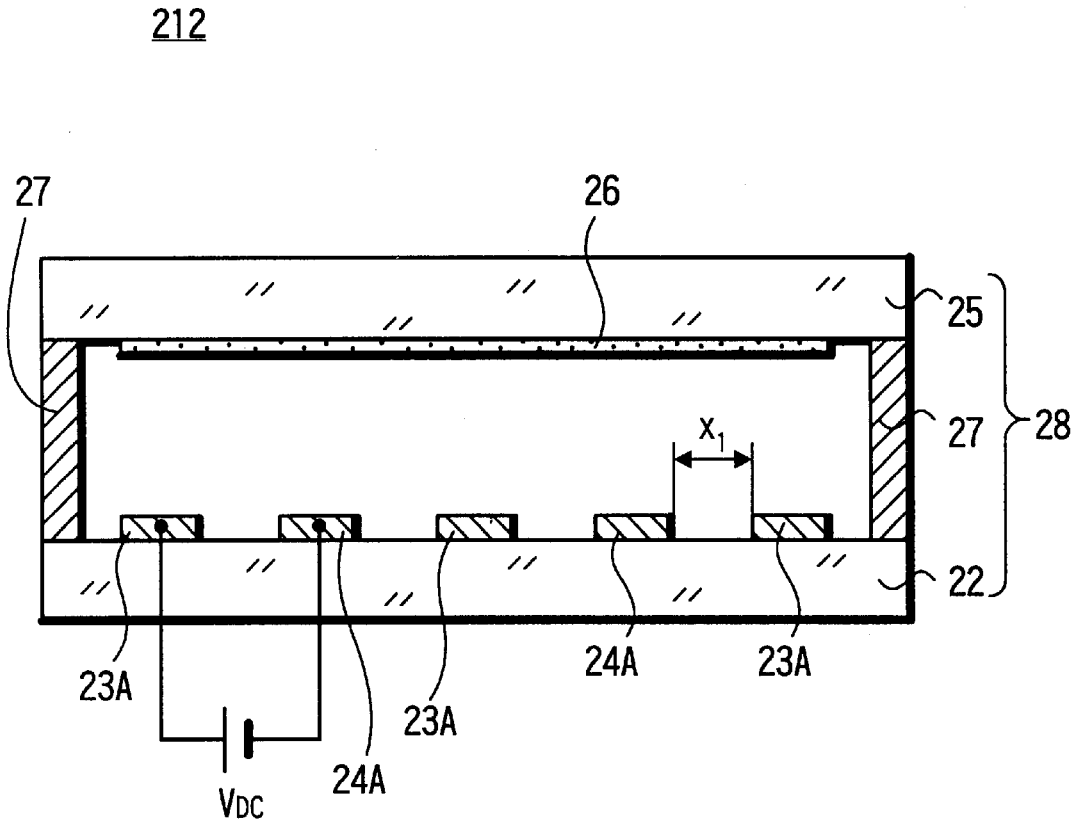
FIG. 9 is a cross-sectional view showing an example of a flat illumination light of a DC drive system according to the first embodiment of the present invention.

FIG. 9 is a diagram showing an example of a flat illumination light 212 of a DC drive system. In this flat illumination light 212, a DC voltage $V_{DC}$ is applied between the anode 23 and the cathode 24. In this case, the cathode 24 is a transparent electrode formed of an oxidized metal film such as the ITO film, the $SnO_2$ film, the $I_2O_3$ film or the like, and the anode 23 is formed of metal such as Al, Cu, Ni, Fe, Cr, Zn, Au, Ag, Pb or the like or of alloy formed of some of the above metals. This combination increases the lifetimes of the electrodes.

Operational principles of the flat illumination lights 211 and 212, respectively shown, in FIGS. 8 and 9 are similar to those described with reference to FIGS. 3 and 4 and hence need not to be described.

The flat illumination light 211 of the AC drive system shown in FIG. 8 can be manufactured as follows.

The anode 23 and the cathode 24, which are discharge electrodes, are formed on one surface of the glass substrate 22 serving as a first substrate by printing or photolithography so as to be located at the above desired interval $x_1$.

Subsequently, the dielectric layer 34 formed of, for example, a glass layer or the like is formed on an entire surface of the substrate 22 so as to cover the anode 23 and the cathode 24, and further the MgO film 35 serving as the protective film is deposited on the dielectric layer 34.

The fluorescent layer 26 is formed on the one surface of, for example, the glass substrate 25 serving as the second substrate.

The first glass substrate 22 and the second glass substrate 25 are disposed so that the electrodes 23 and 24 and the fluorescent layer 26 are located at their inner sides, i.e., the MgO film 35 and the fluorescent layer 26 are opposite each other. The first and second glass substrates 22 and 25 are airtightly sealed through the spacer 27 with a predetermined interval therebetween to form the sealed vessel 28.

Then, the discharge gas is introduced into the sealed vessel 28 so that a pressure therein should be within the range from 0.8 to 3.0 atmospheric pressure, thus obtaining the flat illumination light 211 of the AC drive system.

The flat illumination light 212 of the DC drive system shown in FIG. 9 can be manufactured as follows.

The anode 23 and the cathode 24, which are discharge electrodes, are formed on one surface of, for example, the glass substrate 22 serving as a first substrate by printing or photolithography or the like so as to be located at the above desired interval $x_1$.

Subsequently, the fluorescent layer 26 is coated on the one surface of, for example, the glass substrate 25 serving as the second substrate.

The first glass substrate 22 and the second glass substrate 25 are disposed so that the electrodes 23 and 24 and the fluorescent layer 26 are located opposite each other. The first and second glass substrates 22 and 25 are airtightly sealed through the spacer 27 with a predetermined interval therebetween, thereby forming the sealed vessel 28.

Then, the discharge gas is introduced into the sealed vessel 28 so that a pressure therein falls within the range from 0.8 to 3.0 atmospheric pressure, thus obtaining the flat illumination light 212 of the DC drive system.

In the above flat illumination lights 211 and 212, the high-luminance emitted light is irradiated to the outside from both the first glass substrate 22 side where the electrodes 23 and 24 are formed and the second glass substrate 25 side where the fluorescent layer 26 is formed. Accordingly, when the light irradiates in both directions in the flat illumination lights 211 and 212, it is possible to achieve an effect of illuminating the surroundings. It is needless to say that light irradiates through only the first substrate 22 side or the second substrate 25 side in the flat illumination lights 211 and 212 if either side is shielded.

In this case, the light transmitted through the fluorescent layer 26 is partially absorbed by the fluorescent layer 26. In general, if the thickness of the fluorescent layer is set within the range from 20 to 40 μm, then the luminance of the light emitted from a surface of a fluorescent substance resulting from irradiation of ultraviolet rays is about two to three times as large as luminance of the light emitted from the fluorescent substance after being transmitted therethrough.

If only the light irradiated through either of the first and second glass substrates 22 and 25 is employed for illumination, then a part of high-luminance emitted light is irradiated through the opposite-side glass substrate to the rear side, which loses the emitted light and consequently lowers the luminance.

A flat illumination light according to a second embodiment of the present invention which improves the above disadvantage will be described.

Figure 10:
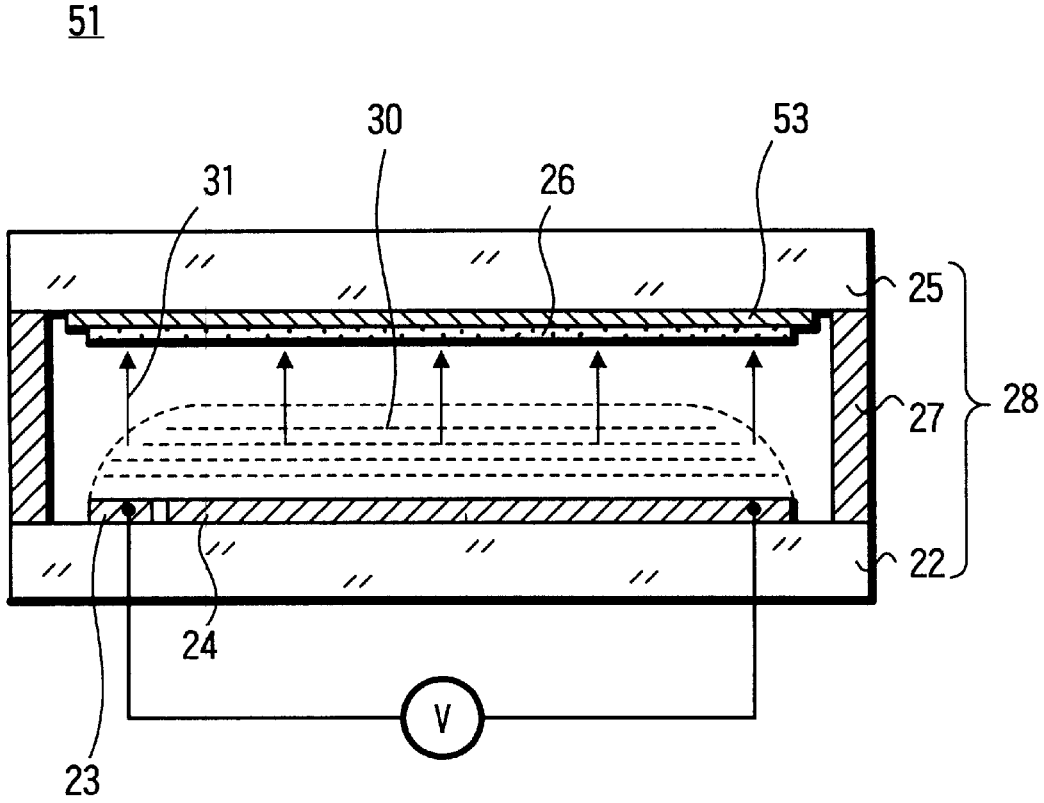
FIG. 10 is a cross-sectional view showing a principle of an arrangement of the flat illumination light according to a second embodiment of the present invention.

FIG. 10 is a diagram showing an arrangement of a flat illumination light 51 according to the second embodiment of the present invention, which employs only light irradiated from a first substrate 22 side where electrodes 23 and 24 are formed.

As shown in FIG. 10, the flat illumination light 51 according to the second embodiment has a pair of discharge electrodes, i.e., an anode 23 and a cathode 24 formed on one surface of a first substrate, e.g., a glass substrate 22. A reflective layer 53 is formed of a high-reflectivity material such as aluminum (Al), nickel (Ni), silver (Ag) or the like, (aluminum in this embodiment) by evaporation or sputtering on one surface of a second substrate, e.g., a glass substrate 25, and then a fluorescent layer 26 is formed on the reflective layer 53 by coating.

The first glass substrate 22 and the second glass substrate 25 are disposed opposite each other and so that the anode 23 and the cathode 24 and the fluorescent layer 26 should be disposed on their inner sides, respectively. The first and second glass substrates 22 and 25 are airtightly sealed and kept away from each other at a predetermined interval through a spacer 27, thereby forming a sealed vessel 28.

Other modifications in an electrode interval $x_1$, kinds of introduced gases, the pressure of the introduced gases, a pitch P of an electrode pair, shapes of the electrodes 23 and 24 and so on are similar to those of the arrangements shown in FIGS. 3, 4, 6 and 7A to 7C and hence need not be described in detail.

In this flat illumination light 51, when the predetermined voltage V is applied between the anode 23 and the cathode 24, the discharge is produced and consequently produces the plasma 30. Then, ultraviolet rays 31 generated by the plasma 30 excites the fluorescent layer 26 and the fluorescent layer 26 emits light. In this case, the emitted light heading for the second glass substrate 25 on the side of the fluorescent layer 26 is reflected by the reflective layer 53 and heads for the first glass substrate 22 on the side of the electrodes 23 and 24. Therefore, the light traveling to the side of the second glass substrate 25 is prevented from being lost, and consequently the luminance of the light irradiated from the side of the first glass substrate 22 is improved, which provides higher-luminance illumination.

A DC voltage or an AC voltage can be employed as a drive voltage applied to the anode 23 and the cathode 24 also in this embodiment.

Figure 11:
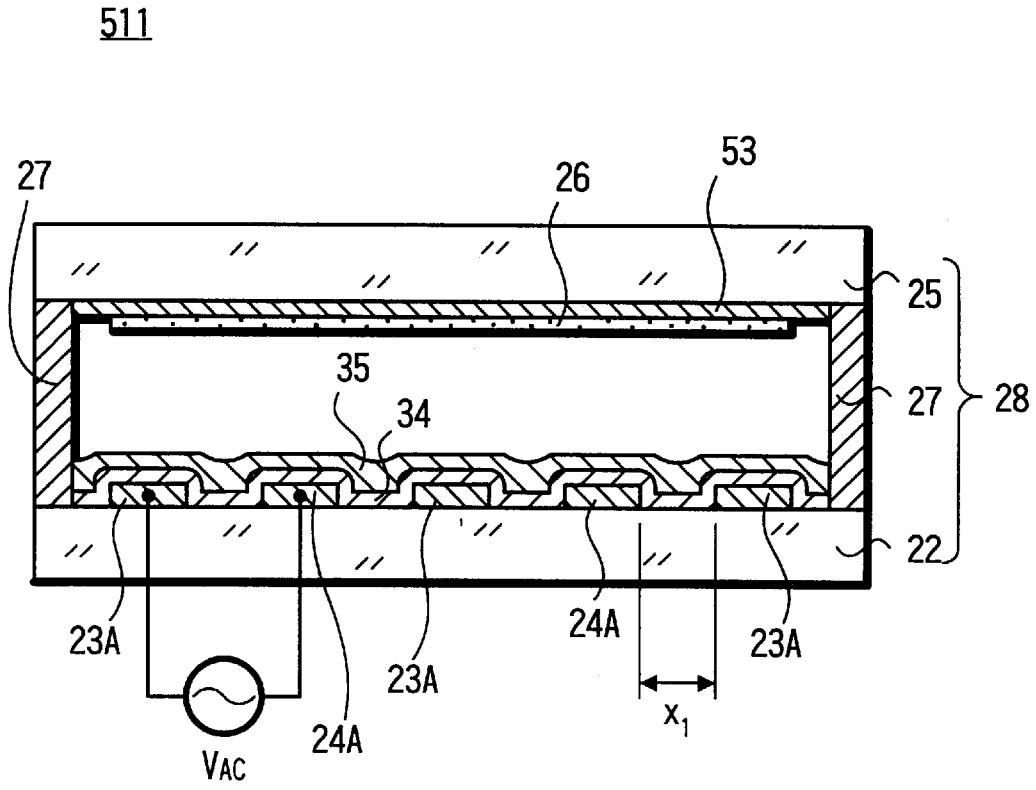
FIG. 11 is a cross-sectional view showing an example of a flat illumination light of an AC drive system according to the second embodiment of the present invention.

FIG. 11 is a diagram showing a flat illumination light 511 of the AC drive system. In this flat illumination light 511, a dielectric layer 34 made of glass, for example, having a thickness ranging from 0.1 to 4.0 μm is formed on both of the electrodes 23 and 24 located at an interval $X_1$ therebetween set to 10 μm, for example. It is preferable to further form on the dielectric layer 34 an MgO layer 35 having a thickness of 0.5 μm, for example, which serves as a protective film and lowers a discharge start voltage. An AC voltage $V_{AC}$ is applied between both of the electrodes 23, 24. In this case, both of the electrodes 23 and 24 employed in the AC drive system may also be transparent electrodes formed of an oxidized metal film such as an ITO film, an $SnO_2$ film, An $I_2O_3$ film or the like, or may be formed of metal such as Al, Cu, Ni, Fe, Cr, Zn, Au, Ag, Pb or the like or of alloy formed of some of the above metals. When both electrodes are formed of metal, since the resistance values thereof are low, they are formed to have a narrow shape so that a numerical aperture for the light transmitting through the glass substrate 22 can be increased.

Figure 12:
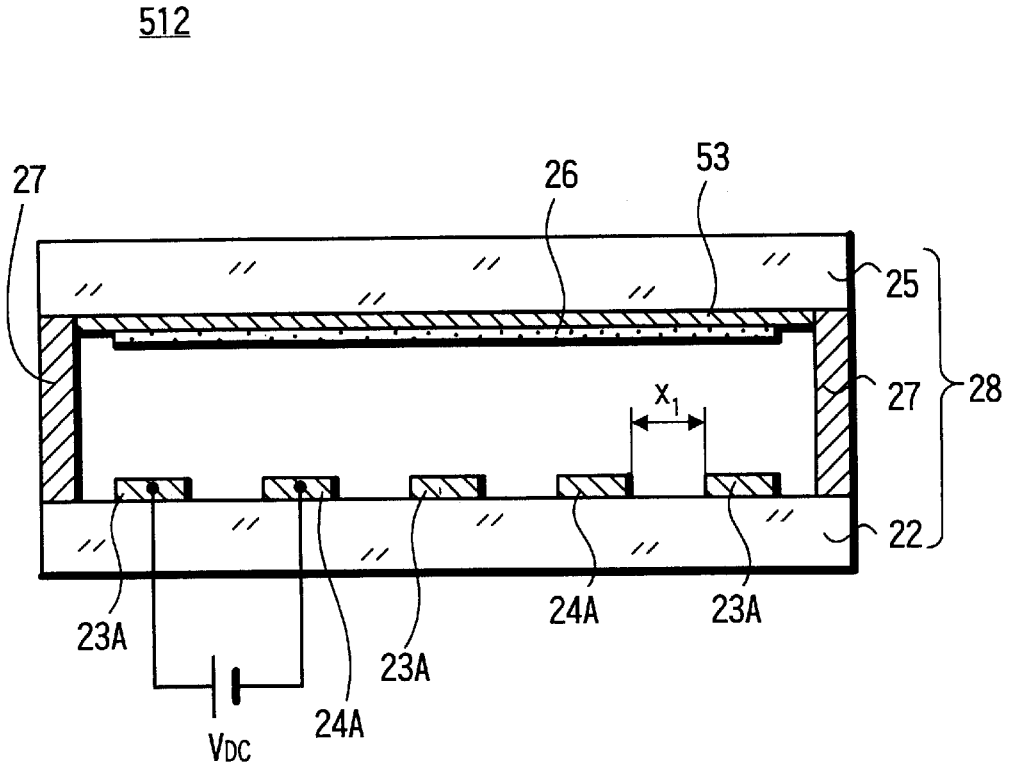
FIG. 12 is a cross-sectional view showing an example of a flat illumination light of a DC drive system according to the second embodiment of the present invention.

FIG. 12 is a diagram showing a flat illumination light 512 of a DC drive system by way of example. In this flat illumination light 512, a DC voltage $V_{DC}$ is applied between the anode 23 and the cathode 24. In this case, the cathode 24 is a transparent electrode formed of an oxidized metal film such as the ITO film, the $SnO_2$ film, the $I_2O_3$ film or the like, and the anode 23 is formed of metal such as Al, Cu, Ni, Fe, Cr, Zn, Au, Ag, Pb or the like or of alloy formed of some of the above metals. This combination increases the lifetime of the electrodes.

In this case, the anode formed of metal can be narrow in order to increase a numeral aperture relative to the light transmitted through the glass substrate 22.

The flat illumination light 511 of the AC drive system shown in FIG. 11 can be manufactured as follows.

The anode 23 and the cathode 24, which are discharge electrodes, are formed on one surface of the glass substrate 22 serving as a first substrate by printing or photolithography so as to be located at the above desired interval $x_1$.

Subsequently, the dielectric layer 34 formed of a glass layer or the like is formed on an entire surface of the substrate 22 so as to cover the anode 23 and the cathode 24, and further the MgO film 35, which serves as the protective film, is deposited on the dielectric layer 34.

A film of high-reflectivity metal, e.g., aluminum is formed by evaporation or sputtering on the one surface of the glass substrate 25 serving as the second substrate, thereby forming a reflective layer 53 having a thickness ranging substantially from 1000 to 10000 Å. Then, the fluorescent layer 26 is formed by coating on the reflective layer 53.

The first glass substrate 22 and the second glass substrate 25 are disposed so that the electrodes 23 and 24 and the fluorescent layer 26 are located at their inner sides. i.e., the MgO film 35 and the fluorescent layer 26 lie opposite each other. The first and second glass substrates 22 and 25 are airtightly sealed through the spacer 27 with a predetermined interval therebetween, thereby forming the sealed vessel 28.

Then, the discharge gas is introduced into the sealed vessel 28 so that a pressure therein should be within the range from 0.8 to 3.0 atmospheric pressure, thus obtaining the flat illumination light 511 of the AC drive system.

The flat illumination light 212 of the DC drive system shown in FIG. 12 can be manufactured as follows.

The anode 23 and the cathode 24, which are discharge electrodes, are formed on one surface of the glass substrate 22 serving as a first substrate by printing or photolithography or the like so as to be located at the above desired interval $x_1$.

A film of high-reflectivity metal, e.g., aluminum is formed by evaporation or sputtering on the one surface of the glass substrate 25 serving as the second substrate, thereby forming a reflective layer 53 having a thickness ranging substantially from 1000 to 10000 Å. Then, the fluorescent layer 26 is formed by coating on the reflective layer 53.

The first glass substrate 22 and the second glass substrate 25 are disposed so that the electrodes 23 and 24 and the fluorescent layer 26 are located opposite each other. The first and second glass substrates 22 and 25 are airtightly sealed through the spacer 27 with a predetermined interval therebetween, thereby forming the sealed vessel 28.

Then, the discharge gas is introduced into the sealed vessel 28 so that a pressure therein is within the range from 0.8 to 3.0 atmospheric pressure, thus obtaining the flat illumination light 512 of the DC drive system.

Figure 13:
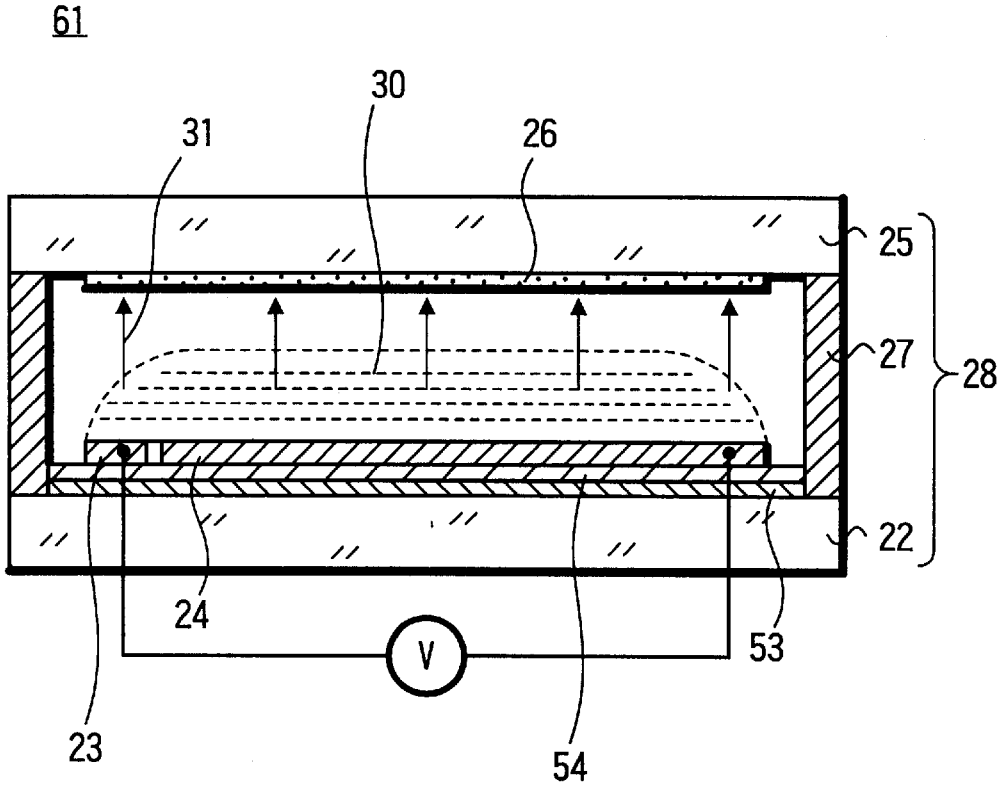
FIG. 13 is a cross-sectional view showing a principle of an arrangement of the flat illumination light according to a third embodiment of the present invention.

FIG. 13 is a diagram showing a principle of an arrangement of a flat illumination light 61 according to a third embodiment of the present invention which employs only light irradiated from a first substrate 22 side where electrodes 23 and 24 are formed.

As shown in FIG. 13, a reflective layer 53 is formed of a high-reflectivity material such as aluminum (Al), nickel (Ni), silver (Ag) or the like, aluminum in this embodiment, by evaporation or sputtering on one surface of a first substrate, e.g., a glass substrate 22, and an insulating film 54 is formed on the reflective layer 53. A pair of discharge electrodes, i.e., an anode 23 and a cathode 24 are formed on the insulating film 54. A fluorescent layer 26 is formed on the one surface of a second substrate, e.g., a glass substrate 25 by coating.

The first glass substrate 22 and the second glass substrate 25 are disposed opposite each other so that the anode 23 and the cathode 24 and the fluorescent layer 26 are disposed on their inner sides, respectively. The first and second glass substrates 22 and 25 are airtightly sealed and kept away from each other at a predetermined interval through a spacer 27, thereby forming a sealed vessel 28.

Other modifications in an electrode interval $x_1$, kinds of introduced gas, the pressure of the introduced gases, a pitch P of an electrode pair, shapes of the electrodes 23 and 24 and so on are similar to those of the arrangements shown in FIGS. 3, 4, 6 and 7A to 7C and hence need not to be described in detail.

In this flat illumination light 61, when a predetermined voltage V is applied between the anode 23 and the cathode 24, the discharge is produced and consequently produces a plasma 30. Then, ultraviolet rays 31 generated by the plasma 30 excites the fluorescent layer 26 and the fluorescent layer 26 emits light. In this case emitted light heading for the first glass substrate 22 on the side of the electrodes 23 and 24 is reflected by the reflective layer 53 and heads for the second glass substrate 25 on the side of the fluorescent layer 26. Therefore, the light traveling to the side of the first glass substrate 22 is prevented from being lost, and consequently the luminance of the light irradiated from the side of the second glass substrate 25 is improved, which provides higher-luminance illumination.

A DC voltage or an AC voltage can be employed as a drive voltage applied to the anode 23 and the cathode 24 also in this embodiment.

Figure 14:
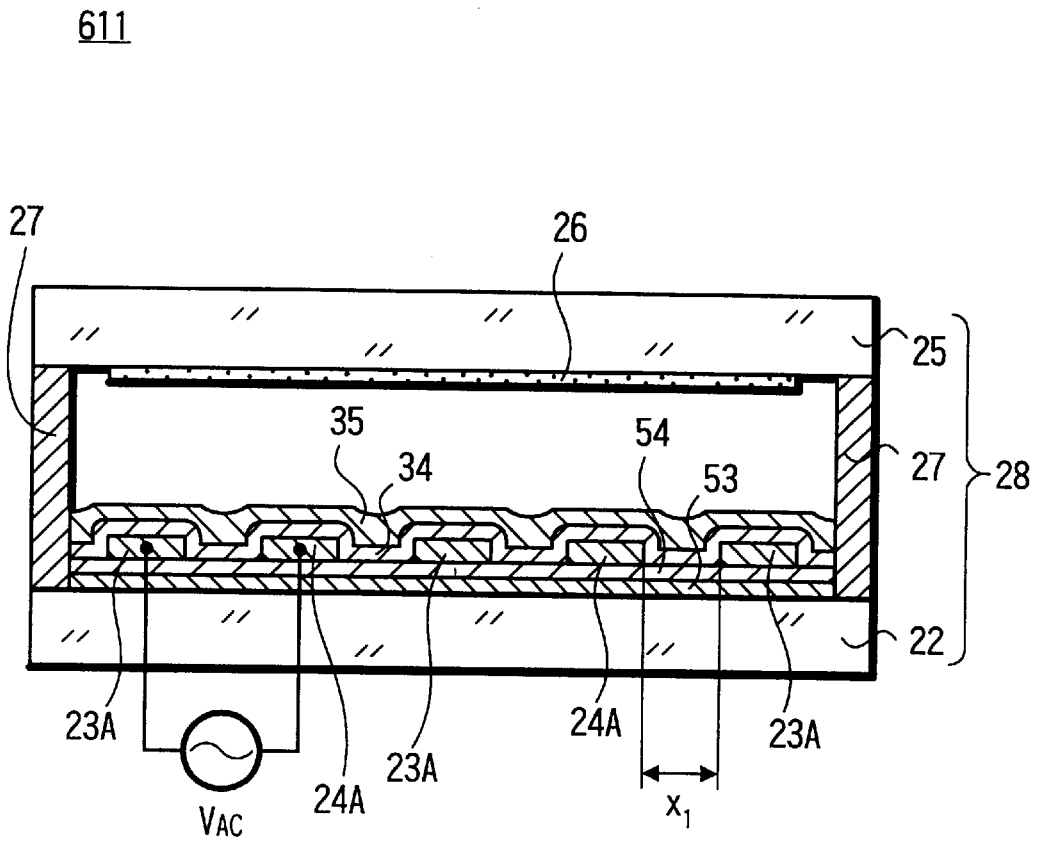
FIG. 14 is a cross-sectional view showing an example illumination light of an AC drive system according to the third embodiment of the present invention.

FIG. 14 is a diagram showing a flat illumination light 611 of the AC drive system. In this flat illumination light 611, a dielectric layer 34 formed of a glass layer, for example, having a thickness ranging from 0.1 to 4.0 $\mu$m is formed on both of the electrodes 23 and 24 located at an interval $X_1$ therebetween set to 10 $\mu$m, for example. It is preferable to further form on the dielectric layer 34 an Mgo layer having a thickness of 0.5 $\mu$m, for example, which serves as a protective film and lowers a discharge start voltage. An AC voltage $V_{AC}$ is applied between both of the electrodes 23, 24. In this case, both of the electrodes 23 and 24 may also be formed of an oxidized metal film or metal similar to those described with reference to FIGS. 8 and 11.

Figure 15:
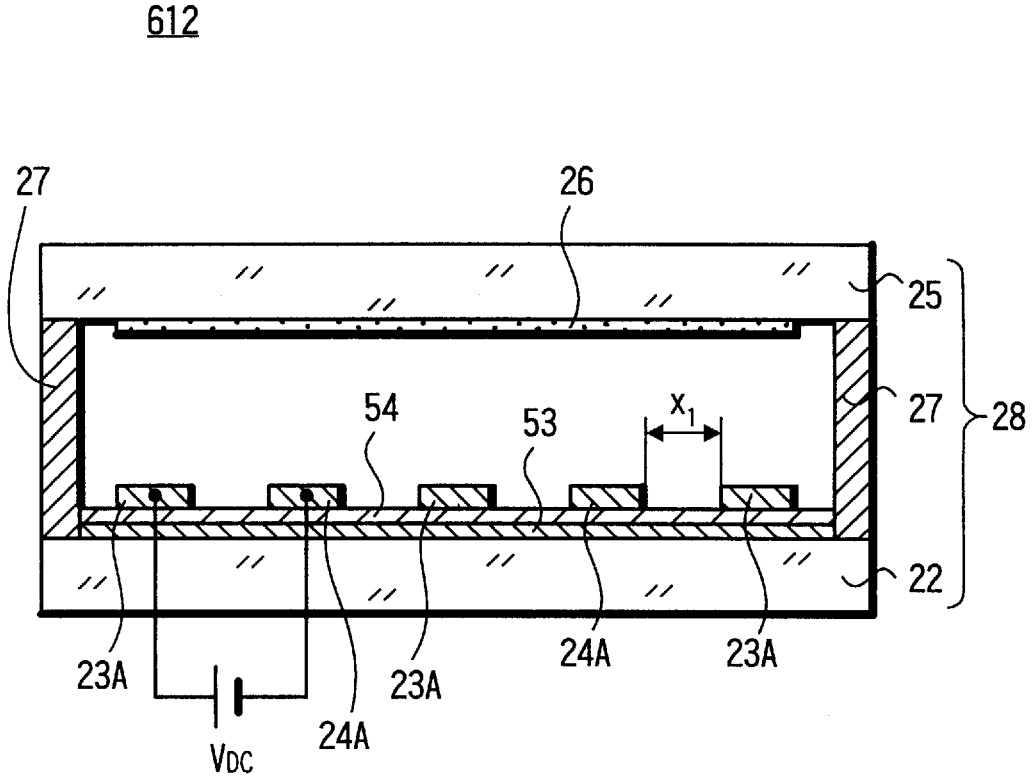
FIG. 15 is a cross-sectional view showing an example of a flat illumination light of a DC drive system according to the third embodiment of the present invention.

FIG. 15 is a diagram showing a flat illumination light 612 of a DC drive system by way of example. In this flat illumination light 612, a DC voltage $V_{DC}$ is applied between the anode 23 and the cathode 24 similarly as described above. Similarly as described above with reference to FIGS. 9 and 12, the cathode 24 is formed of an oxidized metal, and the anode 23 is formed of metal.

The flat illumination light 611 of the AC drive system shown in FIG. 14 can be manufactured as follows.

A film of high-reflectivity metal, e.g., aluminum is formed by evaporation or sputtering on the one surface of the glass substrate 22 serving as the first substrate, thereby forming the reflective layer 53 having a thickness ranging substantially from 1000 to 10000 Å.

Subsequently, an insulating film (e.g., an $SiO_2$ film), 54 having a thickness ranging substantially from 0.5 to 10.0 $\mu$m is formed on the reflective layer 53 by chemical vapor deposition (CVD) or evaporation.

The anode 23 and the cathode 24, which are discharge electrodes, are formed on the insulating film 54 by printing or photolithography or the like so as to be located at the above desired interval $x_1$.

Subsequently, the dielectric layer 34, formed of a glass layer or the like, is formed over the entire surface so as to cover the anode 23 and the cathode 24, and further the MgO film 35, which serves as the protective film, is deposited on the dielectric layer 34.

Then, the fluorescent layer 26 is formed via coating on one surface of a second substrate, e.g., glass substrate 25.

The first glass substrate 22 and the second glass substrate 25 are disposed so that the electrodes 23 and 24 and the fluorescent layer 26 are located at their inner sides, i.e., the MgO film 35 and the fluorescent layer 26 are opposite each other. The first and second glass substrates 22 and 25 are air tightly sealed through the spacer 27 with a predetermined interval therebetween, thereby forming the sealed vessel 28.

Then, the discharge gas is introduced into the sealed vessel 28 so that a pressure therein should be within the range from 0.8 to 3.0 atmospheric pressure, thus obtaining the flat illumination light 611 of the AC drive system.

The flat illumination light 612 of the DC drive system shown in FIG. 15 can be manufactured as follows.

A film of high-reflectivity metal, e.g., aluminum is formed by evaporation or sputtering on the one surface of the glass substrate 22 serving as the first substrate, thereby forming the reflective layer 53 having a thickness ranging substantially from 1000 to 10000 Å.

Subsequently, an insulating film (e.g., an $SiO_2$ film) 54 having a thickness ranging substantially from 0.5 to 10.0 should be within the range m is formed on the reflective layer 53 by chemical vapor deposition (CVD) or evaporation.

The anode 23 and the cathode 24, which are discharge electrodes, are formed on the insulating film 54 by printing or photolithography or the like so as to be located at the above desired interval $x_1$.

Then, the fluorescent layer 26 is formed via coating on one surface of a second substrate, e.g., glass substrate 25.

The first glass substrate 22 and the second glass substrate 25 are disposed so that the electrodes 23 and 24 and the fluorescent layer 26 are opposite each other. The first and second glass substrates 22 and 25 are airtightly sealed through the spacer 27 with a predetermined interval therebetween, thereby forming the sealed vessel 28.

Then, the discharge gas is introduced into the sealed vessel 28 so that a pressure therein is within the range from 0.8 to 3.0 atmospheric pressure, thus obtaining the flat illumination light 612 of the DC drive system.

The flat illumination lights according to the above embodiments of the present invention can be employed for a conventional illumination device and can also be applied to a backlight of a liquid crystal display device and so on.

According to the flat illumination light of the present invention, it is possible to obtain a thin and flat illumination light and to obtain high-luminance illumination. Therefore, the flat illumination light according to the present invention can be applied to normal illumination devices, a backlight of a liquid crystal display device, and so on.

Since the reflective layer is formed on the second substrate on the fluorescent layer side, all the emitted rays of light can be irradiated through the first substrate on the discharge electrode side. Therefore, it is possible to provide a flat illumination light having higher luminance.

Since the reflective layer is formed on the first substrate on the discharge electrode side, all the emitted rays of light can be irradiated through the second substrate on the fluorescent layer side. Therefore, it is possible to provide a flat illumination light having higher luminance.

Since the surfaces, which are opposite each other, of the pair of the discharge electrodes are formed so as to be nonlinear, it is possible to substantially increase the length of the electrodes, and hence it is possible to improve the luminance of the flat illumination light.

When the pitch of the discharge electrode pair is P, the distance in a discharge space between the discharge electrode and the fluorescent layer is L and the discharge angle is $\theta$, if the values of P, L and $\theta$ are set so as to satisfy $P \leqq 2L \tan \theta$, then it is possible to obtain light emitted uniformly over an entire surface.

Since Hg gas is mixed with the sealed gas, ultraviolet rays having a wavelength of 365 nm is produced, which considerably increases the luminance of the light emitted from a fluorescent substance.

When the flat illumination light employs the DC drive system, the cathode is formed of oxidized metal, and the anode is formed of metal. When the flat illumination light employs the AC drive system, both the cathode and the anode are formed of oxidized metal or metal. Therefore, it is possible to increase the lifetime of the electrode.

When the flat illumination light employs the AC drive system, since the flat illumination light has the dielectric layer on the surface of the discharge electrode, it is possible to prevent the deterioration of the discharge electrode and to increase the lifetime thereof. Moreover, since the flat illumination light has the protective film, e.g., the MgO film formed on the surface of the dielectric layer, it is possible to protect the dielectric layer and to lower the discharge start voltage.

According to the manufacturing method of the present invention, it is possible to manufacture the flat illumination lights of the DC drive type and the AC drive type and to further manufacture the flat illumination lights of each of drive type of is two-surface irradiation type and of one-side irradiation type.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A flat illumination light, comprising:

a plurality of discharge electrodes formed on a first substrate with an interval between adjacent discharge electrodes being set to 50 $\mu$m or smaller;

a reflective layer and a fluorescent layer formed on a second substrate opposite said first substrate; and a sealed vessel formed by said first and second substrates so that said electrodes and said fluorescent layer are located on inner sides of said first and second substrates, wherein gasses of one or more kinds of He, Ne, Ar, Xe and Kr are introduced into said sealed vessel so that a pressure of said introduced gasses is above 1.0 atmospheric pressure.

2. A flat illumination light according to claim 1, wherein said reflective layer is formed between said second substrate and said fluorescent layer.

3. A flat illumination light according to claim 1, wherein said reflective layer is formed of high-reflectivity material.

4. A flat illumination light according to claim 3, wherein said high-reflectivity material is aluminum.

5. A flat illumination light according to claim 1, wherein Hg gas is mixed in said sealed vessel.

6. A flat illumination light according to claim 1, wherein application of a voltage to one of said plurality of electrodes is carried out by a DC drive or an AC drive.

7. A flat illumination light according to claim 1, wherein in said DC drive, one of said plurality of electrodes is a cathode and is formed of oxidized metal, wherein another of said plurality of electrodes is an anode and is formed of metal.

8. A flat illumination light according to claim 1, wherein in said AC drive, one of said plurality of electrodes is a cathode and another of said plurality of electrodes is an anode, and wherein said cathode and said anode are formed of oxidized metal or metal.

9. A flat illumination light according to claim 1, wherein if a pitch of a pair of said plurality of discharge electrodes is P, a distance between one of said plurality of discharge electrodes in said pair and said fluorescent layer is L and a discharge angle is $\theta$, then P, L and $\theta$ are set so as to satisfy $P \leqq 2L \tan \theta$.

10. A flat illumination light according to claim 1, wherein opposing surfaces of a pair of said plurality discharge electrodes formed on the same plane are formed to be nonlinear.

11. A flat illumination light according to claim 1, wherein a dielectric layer or a dielectric layer and a protective layer are formed on a surface of at least one of said plurality of discharge electrodes.

12. A flat illumination light according to claim 11, wherein said protective layer is made of MgO.

13. A flat illumination light according to claim 11, wherein application of a voltage to one of said plurality of discharge electrodes is carried out by an AC drive.

14. A flat illumination light according to claim 11, wherein Hg gas is mixed in said sealed vessel.

15. A flat illumination light according to claim 13, wherein one of said plurality of discharge electrodes is a cathode and another of said plurality of discharge electrodes is an anode, and wherein said cathode and said anode are both formed of oxidized metal or metal.

16. A flat illumination light according to claim 11, wherein if a pitch of a pair of said plurality of discharge electrodes is P, a distance between one of said plurality of discharge electrodes in said pair and said fluorescent layer is L and a discharge angle is $\theta$, then P, L and $\theta$ are set so as to satisfy $P \leqq 2L \tan \theta$.

17. A flat illumination light according to claim 11, wherein opposing surfaces of a pair of said plurality of discharge electrodes formed on the same plane are formed to be nonlinear.

18. The flat illumination light of claim 1, wherein the pressure of the introduced gasses is between 1.0 and 3.0 atmospheric pressure.

19. The flat illumination light of claim 1, wherein a first set of said plurality of discharge electrodes are anodes and a second set of said plurality of discharge electrodes are cathodes, and wherein said anodes and said cathodes are alternately arranged in an interleaving relationship.

20. A method of manufacturing a flat illumination light, comprising the steps of:

forming a discharge electrode on a first substrate;

forming a reflective layer and a fluorescent layer on a second substrate;

forming a sealed vessel by locating said first substrate and said second substrate so that said discharge electrode and said fluorescent layer are located on inner sides of said first and second substrates; and introducing a discharge gas into said sealed vessel so that a pressure in said sealed vessel is above 1.0 atmospheric pressure.

21. The method of claim 20, wherein the pressure of the introduced gasses is between 1.0 and 3.0 atmospheric pressure.

22. A method of manufacturing a flat illumination light, comprising the steps of:

forming a discharge electrode on a first substrate;

forming a dielectric layer or a dielectric layer and a protective layer on said discharge electrode;

forming a reflective layer and a fluorescent layer on a second substrate;

forming a sealed vessel by locating said first substrate and said second substrate so that said discharge electrode and said fluorescent layer are located on inner sides of said first and second substrates; and introducing a discharge gas into said sealed vessel so that a pressure in said sealed vessel is above 1.0 atmospheric pressure.

23. The method of claim 22, wherein the pressure of the introduced gasses is between 1.0 and 3.0 atmospheric pressure.

24. A flat illumination light, comprising:

a reflective film formed on a first substrate;

a plurality of discharge electrodes formed on said first substrate with an interval between adjacent discharge electrodes being set to 50 $\mu$m or smaller;

a fluorescent layer formed on a second substrate opposed to said first substrate; and a sealed vessel formed of said first and second substrates so that said electrodes and said fluorescent layer are located on inner sides of said first and second substrates, wherein gasses of one or more kinds of He, Ne, Ar, Xe and Kr are introduced into said sealed vessel so that a pressure of said introduced gasses is above 1.0 atmospheric pressure.

25. A flat illumination light according to claim 24, wherein said reflective layer is formed between said first substrate and said fluorescent layer.

26. The flat illumination light of claim 25, wherein the pressure of the introduced gasses is between 1.0 and 3.0 atmospheric pressure.

27. A flat illumination light according to claim 24, wherein said reflective layer is formed of high-reflectivity material.

28. A flat illumination light according to claim 27, wherein said high-reflectivity material is aluminum.

29. A flat illumination light according to claim 24, wherein Hg gas is mixed in said sealed vessel.

30. A flat illumination light according to claim 24, wherein application of a voltage to one of said plurality of discharge electrodes is carried out by a DC drive or an AC drive.

31. A flat illumination light according to claim 24, wherein in said DC drive, one of said plurality of discharge electrodes is a cathode and is formed of oxidized metal, and wherein another of said plurality of electrodes is an anode and is formed of metal.

32. A flat illumination light according to claim 24, wherein in said AC drive, one of said plurality of electrodes is a cathode and another of said plurality of electrodes is an anode, and wherein said cathode and said anode are formed of oxidized metal or metal.

33. A flat illumination light according to claim 24, wherein if a pitch of a pair of said plurality of discharge electrodes is P, a distance between one of said plurality of discharge electrodes in said pair and said fluorescent layer is L and a discharge angle is $\theta$, then P, L and $\theta$ are set so as to satisfy $P \leqq 2L \tan \theta$.

34. A flat illumination light according to claim 24, wherein opposing surfaces of a pair of said plurality of discharge electrodes formed on the same plane are formed to be nonlinear.

35. A flat illumination light according to claim 24, wherein a dielectric layer or a dielectric layer and a protective layer are formed on a surface of at least one of said plurality of discharge electrodes.

36. A flat illumination light according to claim 35, wherein said protective layer is made of MgO.

37. A flat illumination light according to claim 35, wherein application of a voltage to one of said plurality of discharge electrodes is carried out by an AC drive.

38. A flat illumination light according to claim 35, wherein Hg gas is mixed in said sealed vessel.

39. A flat illumination light according to claim 35, wherein one of said plurality of discharge electrodes is a cathode and another of said plurality of discharge electrodes is an anode, and wherein said cathode and said anode are both formed of oxidized metal or metal.

40. A flat illumination light according to claim 35, wherein if a pitch of a pair of said plurality of discharge electrodes is P, a distance between one of said plurality of discharge electrodes in said pair and said fluorescent layer is L and a discharge angle is $\theta$, then P, L and $\theta$ are set so as to satisfy $P \leqq 2L \tan \theta$.

41. A flat illumination light according to claim 35, wherein opposing surfaces a pair of said plurality of discharge electrodes formed on the same plane are formed to be nonlinear.

42. The flat illumination light of claim 24, wherein a first set of said plurality of discharge electrodes are anodes and a second set of said plurality of discharge electrodes are cathodes, and wherein said anodes and said cathodes are alternately arranged in an interleaving relationship.

43. A method of manufacturing a flat illumination light, comprising the steps of:

forming a reflective layer on a first substrate to thereafter form a discharge electrode on said reflective layer through an insulating film;

forming a fluorescent layer on a second substrate;

forming a sealed vessel by locating said first substrate and said second substrate so that said discharge electrode and said fluorescent layer are located on inner sides of said first and second substrates; and introducing a discharge gas into said sealed vessel so that a pressure in said sealed vessel is above 1.0 atmospheric pressure.

44. The method of claim 43, wherein the pressure of the introduced gasses is between 1.0 and 3.0 atmospheric pressure.

45. A method of manufacturing a flat illumination light, comprising the steps of:

forming a reflective layer on a first substrate to thereafter form a discharge electrode on said reflective layer through an insulating film;

forming a dielectric layer or a dielectric layer and a protective layer on said discharge electrode;

forming a fluorescent layer on a second substrate;

forming a sealed vessel by locating said first substrate and said second substrate so that said discharge electrode and said fluorescent layer are located on inner sides of said first and second substrates; and introducing a discharge gas into said sealed vessel so that a pressure in said sealed vessel is above 1.0 atmospheric pressure.

46. The method of claim 45, wherein the pressure of the introduced gasses is between 1.0 and 3.0 atmospheric pressure.

* * * * *